US006180115B1

(12) United States Patent
Conrard et al.

(10) Patent No.: US 6,180,115 B1
(45) Date of Patent: Jan. 30, 2001

(54) SPA GEMS MINERAL BATH

(76) Inventors: Laurel Jean Conrard; Glynda Annette Yoder, both of 1044 State Hwy. 325, Rifle, CO (US) 81650

( * ) Notice: Under 35 U.S.C. 154(b), the term of this patent shall be extended for 0 days.

(21) Appl. No.: 09/259,289

(22) Filed: Mar. 1, 1999

(51) Int. Cl.[7] ..... A61K 9/00
(52) U.S. Cl. ..... 424/400
(58) Field of Search ..... 252/90; 383/22; 424/70.1, 400

(56) References Cited

U.S. PATENT DOCUMENTS

| | | | | |
|---|---|---|---|---|
| 3,594,956 | | 7/1971 | Conover | 56/163 |
| 4,659,495 | * | 4/1987 | Figliola | 252/90 |
| 4,943,066 | | 7/1990 | Lathim et al. | 273/415 |
| 5,092,682 | * | 3/1992 | Fenick | 383/22 |
| 5,333,758 | | 8/1994 | Jamison et al. | 222/101 |
| 5,609,419 | | 3/1997 | Byers, Jr. | 383/33 |
| 5,709,479 | | 1/1998 | Bell | 383/209 |
| 5,762,648 | | 6/1998 | Yeazell | 8/137 |

* cited by examiner

*Primary Examiner*—Thurman K. Page
*Assistant Examiner*—Konata M. George
(74) *Attorney, Agent, or Firm*—Morgan, Lewis & Bockius LLP

(57) ABSTRACT

A mineral bath kit is shown having minerals in the form of chips or small rocks mined from the earth, a water-permeable bag for containing the minerals and allowing natural elements to be leached from the minerals when the water-permeable bag is placed in warm water, and a hanger for holding the bag above a water receptacle to soak in water placed in the receptacle or to dry after use. The mineral bath kit is provided in combination with any of a variety of decorative carrying cases that enhance the marketing appeal of the product. The bag includes a loop that can be placed over a hook on the hanger, with the hook being connected to a suction cup for easy attachment to and detachment from a surface over a water receptacle. The minerals used to fill the water-permeable bag include quartz, lepidolite and mica.

15 Claims, 9 Drawing Sheets

700

SPA GEMS MINERAL BATH

BACKGROUND OF THE INVENTION

1. Field of the Invention

The present invention relates to a bath product that includes a water-permeable bag and naturally-occurring minerals contained within the bag. When the bag containing the minerals is placed in water, elements having therapeutic effects on the human body leach from the minerals through the water-permeable bag.

2. Description of the Related Art

Mineral salts and bath soaps are conventionally provided in granular or liquid form to be poured into bath-water or applied to a face-cloth for use when taking a bath. Such traditional bath additives are used only once and then flushed down the drain after completion of a bath. With conventional bath additives, such as bath salts and bubble-bath solutions, a greater amount of the additives than desired can be accidentally added to the bath water. When this happens, more water must be added to dilute the bath additives, or the water must be drained from the bathtub, thus wasting the water and the bath additives. The addition of too much bath additive is especially problematic with spas or other water receptacles containing a large quantity of water and requiring precise control of additives in the water to avoid bacterial or fungal growth.

Conventional bath additives also do not duplicate nature's way of adding therapeutic elements to natural mineral springs. In nature, the elements are gradually leached from naturally occurring minerals as warm water flows over the minerals. Conventional bath additives generally include many man-made chemicals for purposes such as preserving the freshness of the bath additives and adding scents and colors to the bath additives. Often the potential side effects from continued exposure to such man-made chemicals are not fully understood, and people with sensitive skin may experience reactions to such products.

SUMMARY OF THE INVENTION

The present invention has been made in view of the above circumstances and has as an object to provide an aesthetically pleasing and economical means of bringing naturally occurring minerals and the therapeutic elements they contain into contact with water used for bathing.

A further object of the present invention is to provide a bath product that can be reused, and that provides an attractive compliment to the decor of any bathroom or spa.

Yet another object of the invention is to duplicate nature's way of slowly leaching desirable elements with therapeutic effects from naturally occurring minerals that come into contact with warm water.

To achieve the objects and in accordance with the purpose of the invention, as embodied and broadly described herein, the invention comprises a mineral bath kit having naturally occurring minerals mined from the earth provided in a kit in combination with a decorative, water-permeable bag. The kit also includes a hanger that can be used to suspend the bag when it is filled with the minerals in contact with warm water in a bath or spa, or that can be used to hang the bag for drying after use.

The invention further includes the water-permeable bag having a loop connected to the bag, with the hanger being in the form of a hook connected to a suction cup or other temporary or permanent means for suspending the water-permeable bag over a water receptacle.

In one preferred embodiment, a water-permeable bag is provided with a loop connected to an outer surface of the bag, and the bag has an opening through which the minerals can be inserted into the bag. The opening to the bag can be closed after minerals are placed within the bag using hook-and-loop-type closures, such as the product sold under the trademark VELCRO, or rib-and-trough-type closures, such as the product sold under the trademark ZIPLOC.

In another preferred embodiment, the kit including the minerals, the water-permeable bag, and the means for hanging the bag can be provided in combination with a decorative carrying case. The decorative carrying case can take various forms such as a wooden box that is divided into various internal compartments, an obelisk-shaped container, a chest-shaped container, a woven basket with a lid, or other decorative receptacles designed to contain the various components of the bath kit in an attractive arrangement.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments of the invention and together with the description, serve to explain the principles of the invention.

DESCRIPTION OF THE PREFERRED EMBODIMENT

Figure 1:
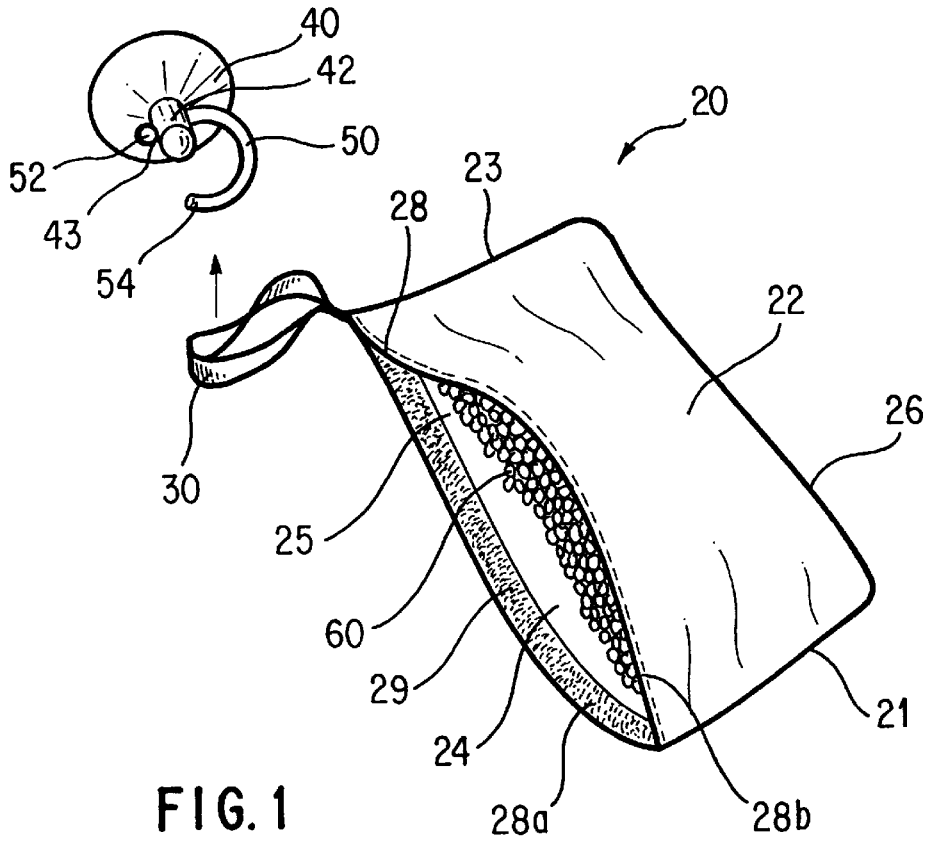
FIG. 1 illustrates a mineral bath kit in accordance with a first embodiment of the invention.

Reference will now be made in detail to the present exemplary embodiments illustrated in the accompanying drawings. Wherever possible, the same reference numerals will be used throughout the drawings to refer to the same or like parts.

FIG. 1 illustrates a first embodiment of the invention. The reference numeral 20 in FIG. 1 generally designates a bag construction or pouch arrangement according to the present invention. The bag construction depicted in FIG. 1 is illustrated as it would generally appear when in an open position and filled with minerals 60. The bag 20 includes a front panel 22 and a rear panel 24, a bottom edge 26, a top edge 28, a first side edge 21, and a second opposite side edge 23. A cavity 25 is defined within the bag between front panel 22 and rear panel 24. The opening into cavity 25 is defined between the front side 28*b* and rear side 28*a* of top edge 28.

In the embodiment shown in FIG. 1, the opening into cavity 25 can be closed by bringing the sides 28*a*, 28*b* of top edge 28 together and joining them along the entire top edge 28. Strips of hook-and-loop-type fastening material, such as materials sold under the trademark VELCRO, can be sewn along the sides 28*a*, 28*b* of top edge 28 such that when the two opposing strips of fastening material are brought together, the opening into the cavity 25 is sealed closed.

The material making up the side panels 22, 24 of bag 20 can be selected from any of a number of water-permeable materials including, but not limited to, synthetic mesh materials such as materials used for hydroponics and pile fabric materials such as terry cloth. In order to preserve the freshness of the minerals 60 during shipping and storage, the minerals 60 can be provided in an air-tight and water-tight bag (not shown) until the bath kit is ready for use. When the bath kit is ready for use, the minerals 60 can be removed from the air-tight and water-tight bag (not shown) and placed into the cavity 25 of bag 20. The top edge 28 of the bag 20 is then sealed closed by bringing sides 28*a*, 28*b* together and joining them using the hook-and-loop-type fasteners 29 or other closures such as rib-and-trough-type closures sold under the trademark ZIPLOC.

A loop 30 can be sewn or otherwise joined to an outer surface of the bag 20, as shown in FIG. 1. The loop 30 provides a means by which the bag 20 can be easily handled or suspended over a water receptacle such that the bag 20 filled with minerals 60 hangs in contact with water or hangs exposed to the air for drying after use.

The bath kit according to the first embodiment of the invention shown in FIG. 1 further includes a suction cup 40, with one end 42 of the suction cup 40 having a through-hole 43 for receipt of a hook 50. One end 52 of the hook 50 can be formed in the shape of a sphere having a diameter larger than hole 43 such that the hook 50 can only be pulled through the hole 43 in one direction. The end 52 of hook 50 prevents the hook from falling out of the hole 43 when the bag 20 is suspended by loop 30 from the hook. An end 54 of the hook 50 opposite from the end 52 can be passed through the loop 30 of water-permeable bag 20 and the suction cup 40 can be pressed against a convenient surface over the water receptacle. The suction cup 40 is formed from any of a variety of pliable, elastomeric materials such as polyethylene.

Figure 2:
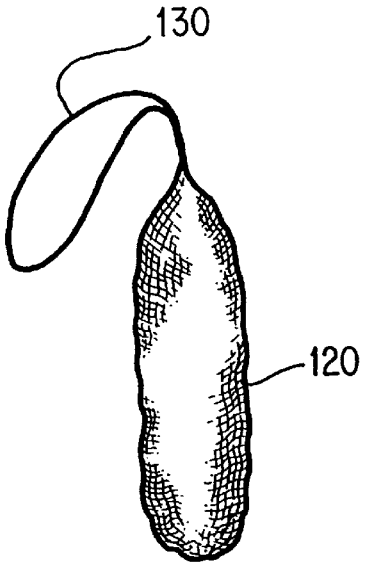
FIG. 2 illustrates a second embodiment of a mineral bath kit according to the invention.
Figure 3:
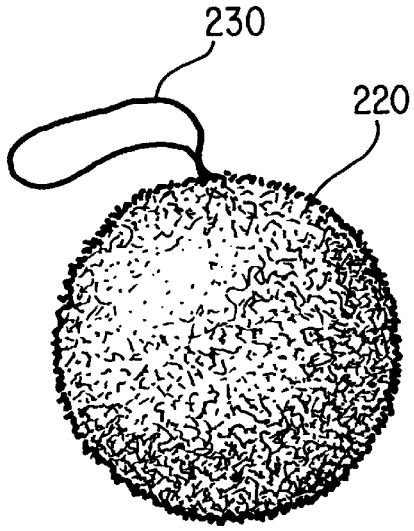
FIG. 3 illustrates a third embodiment of a mineral bath kit according to the invention.

Although the first embodiment shown in FIG. 1 has a water-permeable bag 20 formed substantially rectangular in shape from side panels 22, 24, alternative embodiments can include different shapes such as the cylindrical bag 120 shown in FIG. 2 and the spherical bag 220 shown in FIG. 3. The water-permeable bags can be formed from one or more panels of water-permeable material.

In the embodiment shown in FIG. 3, the water-permeable bag 220 is formed from a pile fabric-type material such as terry cloth and filled with minerals before being used to soap the body during a shower or bath.

The minerals used to fill the water-permeable bags, such as minerals 60 in bag 20 shown in FIG. 1, are preferably in the form of chips or small rocks made from quartz, lepidolite, micas, and other crystals collected as they grew in a unique, enriched geographical location. These naturally occurring minerals contain over 25 individual elements that can be leached from the minerals in contact with warm water, providing a mineral bath with therapeutic effects such as relaxing tired muscles, enhancing sleep, promoting relaxation, and eliminating the effects of stress. The leaching of these desirable therapeutic elements occurs naturally through the water-permeable bag 20 when the bag 20 is filled with the minerals 60, sealed closed, and placed into contact with warm water. The minerals 60 and water-permeable bag 20 can generally be reused many times, and preferably at least 20 times, before all of the naturally occurring elements have been leached from them. After all of the desirable elements have been leached from the minerals 60, attractive crystals remain and can be used for decorative purposes.

In addition to the aesthetic value of the crystals remaining after use of minerals 60, the water-permeable bag 20 can be provided with a decorative motif compatible with the decor of a bathroom where the bath kit is used.

Figure 4:
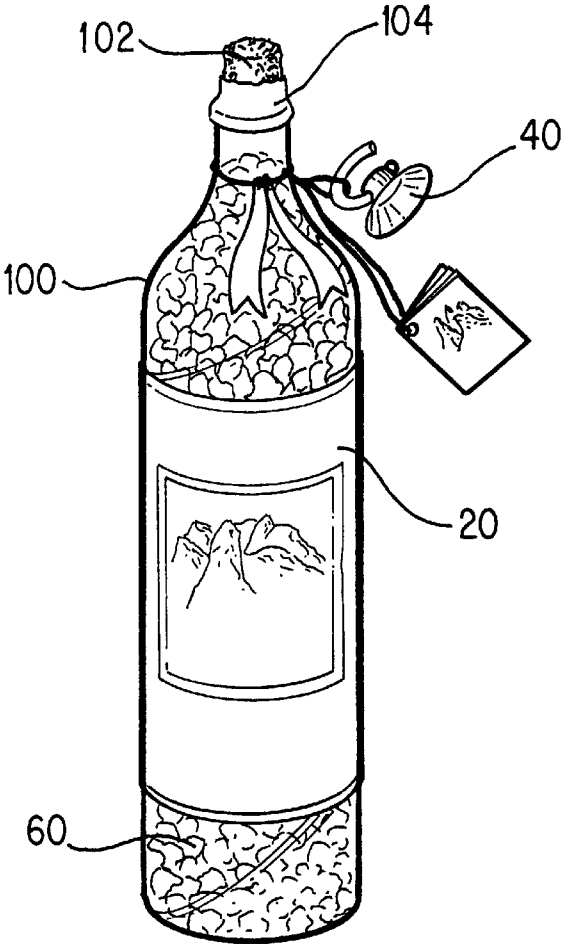
FIG. 4 illustrates a mineral bath kit according to the invention in combination with a first embodiment of a decorative carrying case.

FIG. 4 illustrates a decorative carrying case 100 in the form of a transparent bottle made from glass or plastic and provided with a cork 102 and wax seal 104 after being filled with the minerals 60, thus creating an air-tight and water-tight container for preserving the minerals. The water-permeable bag 20 can be attached around the outer circumference of the bottle 100 using shrink-wrap material.

Figure 5:
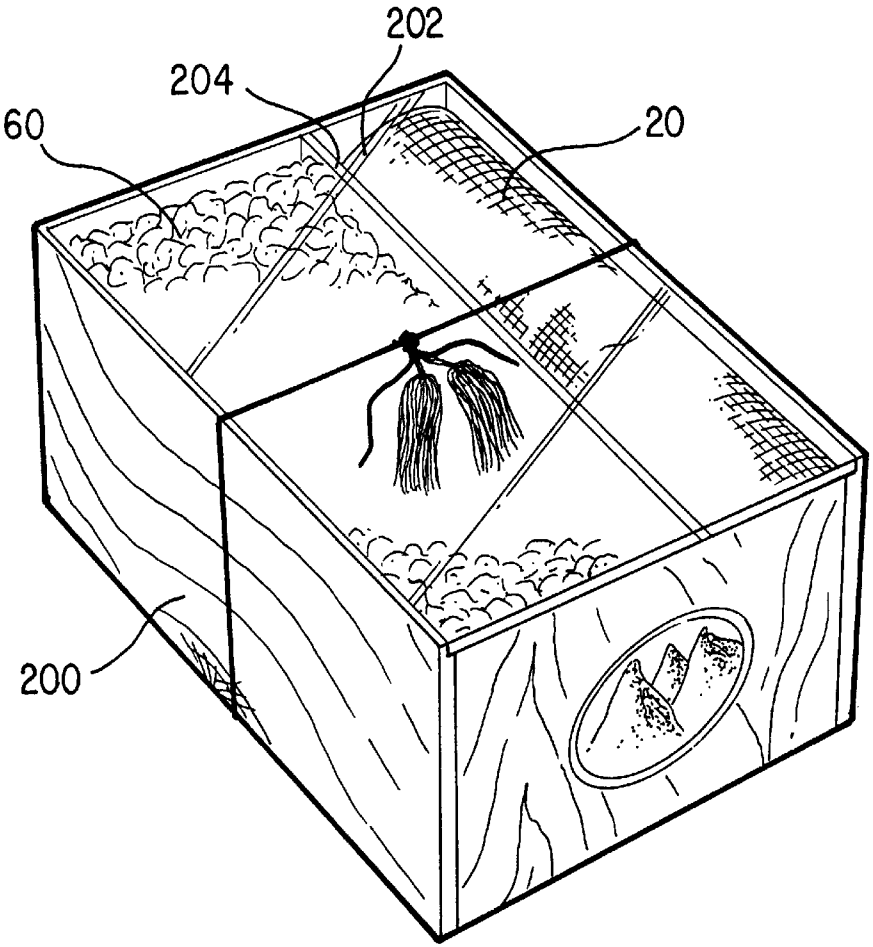
FIG. 5 illustrates a second embodiment of a decorative carrying case in combination with a mineral bath kit according to the invention.

FIG. 5 illustrates a further embodiment of a decorative carrying case 200 in the form of a box made from wood or other wood-like material. A clear glass or plexi-glass cover 202 can be provided over the top of the box 200, and internal partitions 204 separate the box 200 into compartments. The minerals 60 can be placed in one compartment and the rolled-up water-permeable bag 20 can be placed in a second compartment.

Figure 6A:
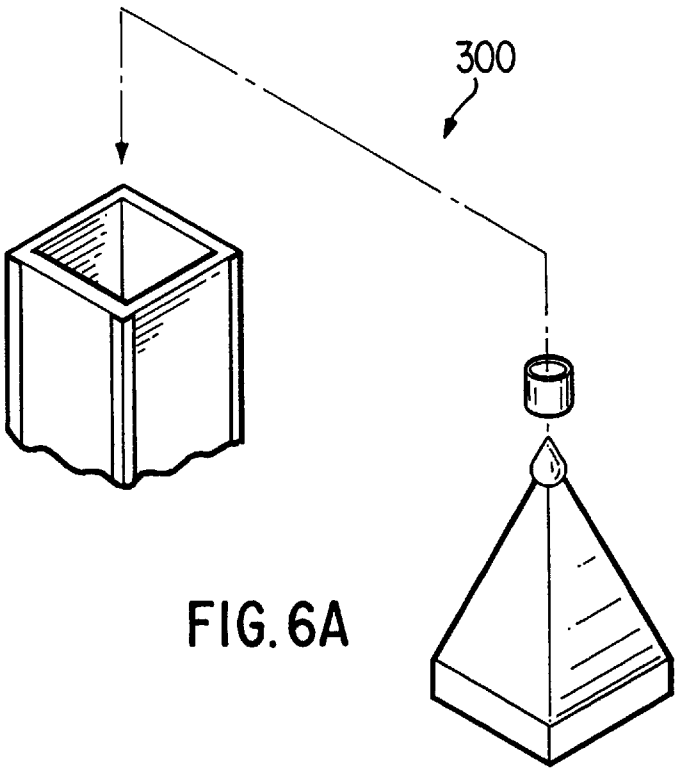
FIG. 6 illustrates a third embodiment of a decorative carrying case.
Figure 6:
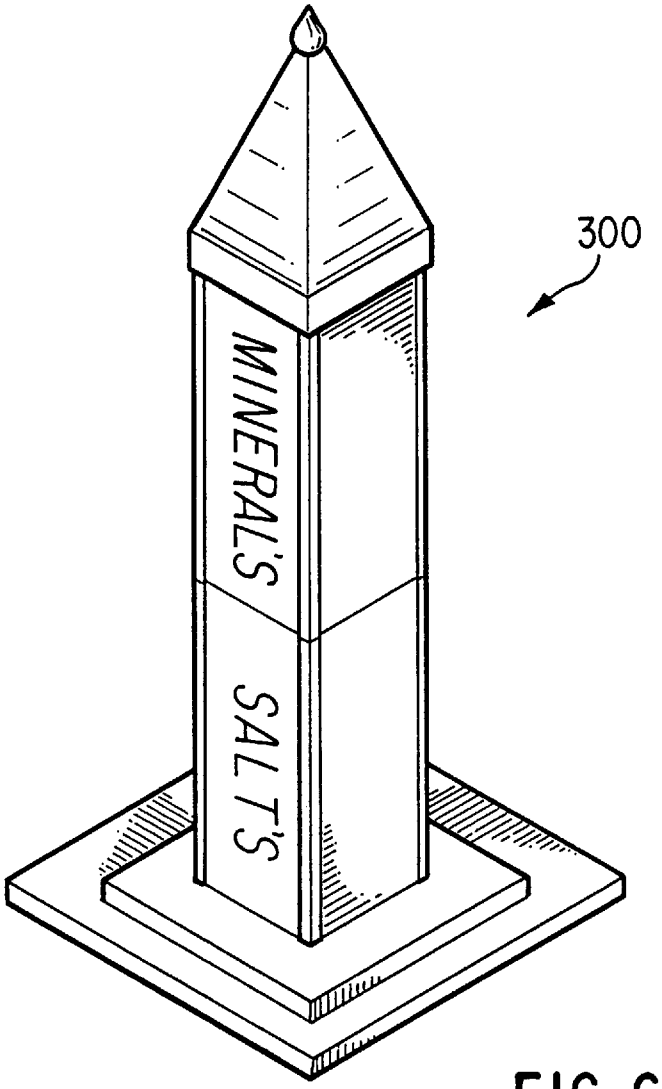

FIG. 6 illustrates another embodiment of a decorative carrying case for the mineral bath kit according to the invention, with the decorative carrying case 300 being in the shape of an obelisk.

Figure 7B:
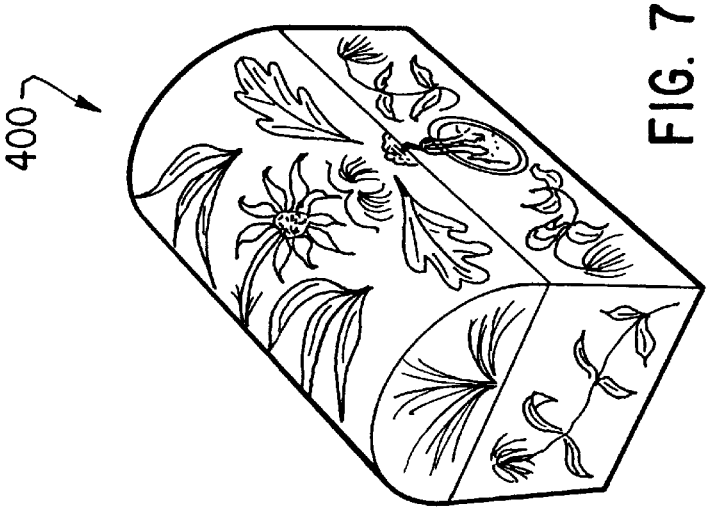
FIG. 7B illustrates the carrying case of FIG. 7A in a closed position.
Figure 7A:
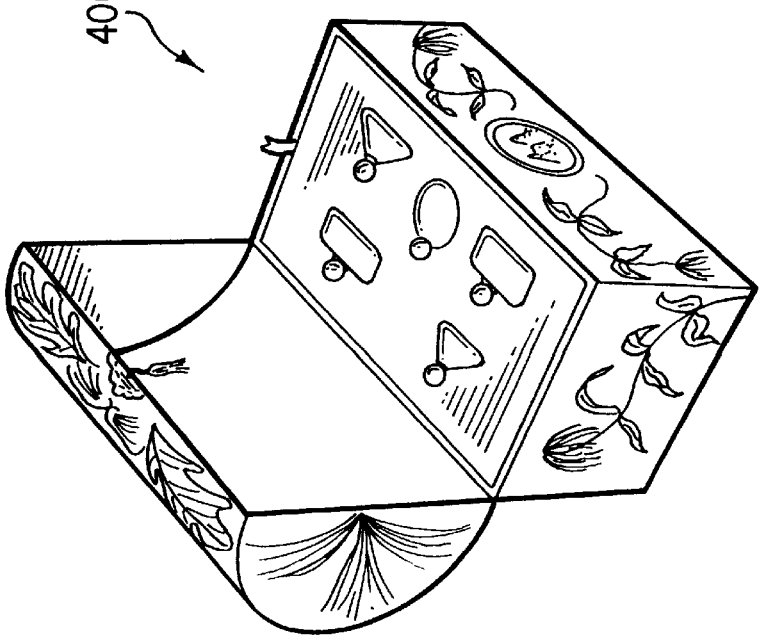
FIG. 7A illustrates a fourth embodiment of a decorative carrying case in an open position.

FIGS. 7A and 7B illustrate still another embodiment of a decorative carrying case 400 for transporting the mineral bath kit according to the invention.

Figure 8:
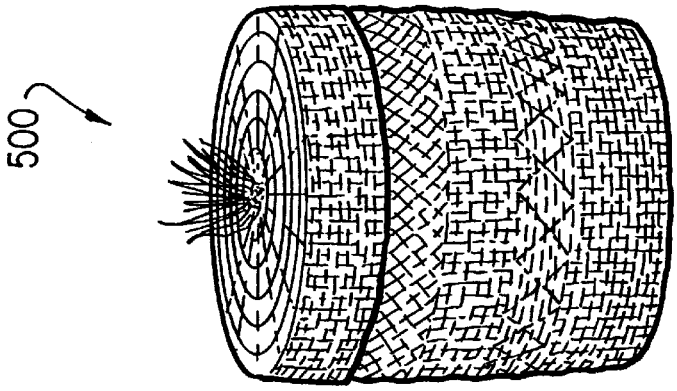
FIG. 8 illustrates a fifth embodiment of a decorative carrying case to be used with the mineral bath kit according to the invention.

FIG. 8 illustrates a decorative carrying case 500 in the form of a Native American basket for transporting the mineral bath kit of the invention.

Figure 9:
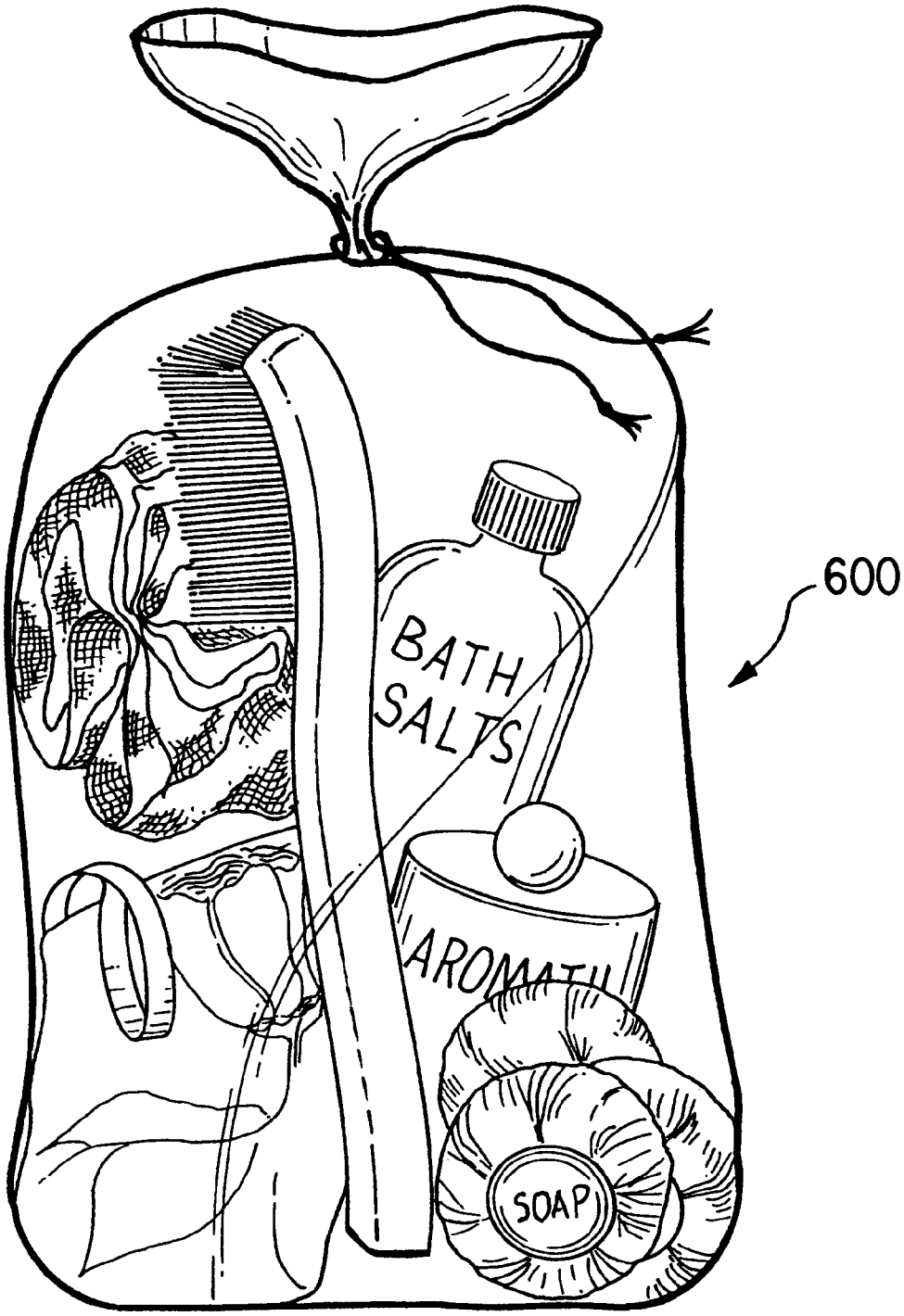
FIG. 9 illustrates a sixth embodiment of a decorative carrying case to be used with the mineral bath kit according to the invention.

FIG. 9 illustrates a decorative carrying case 600 in the form of a simple bag.

Figure 10:
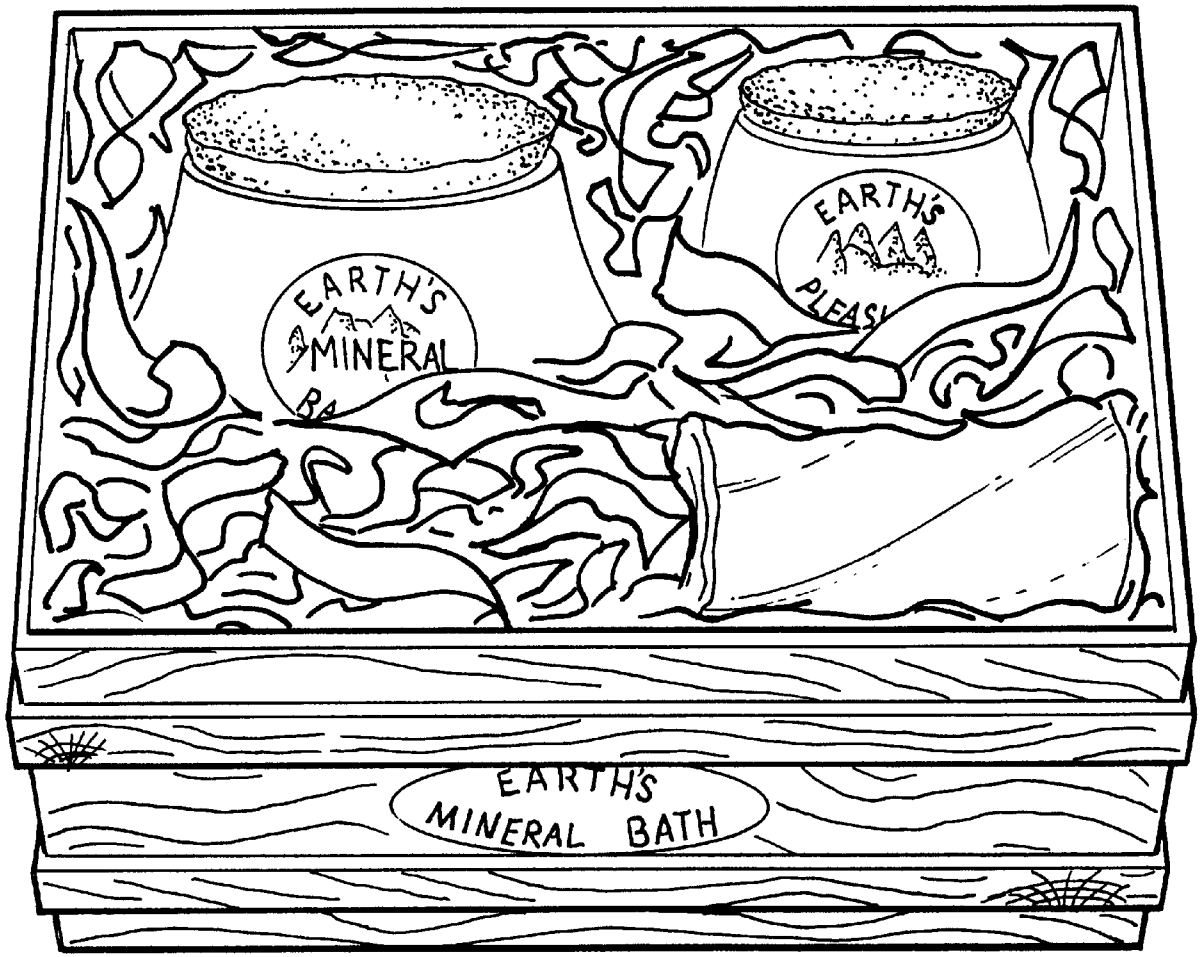
FIG. 10 illustrates a seventh embodiment of a decorative carrying case to be used with the mineral bath kit according to the invention.

FIG. 10 illustrates another embodiment of a decorative carrying case 700 for carrying the mineral bath kit of the invention.

Figure 11A:
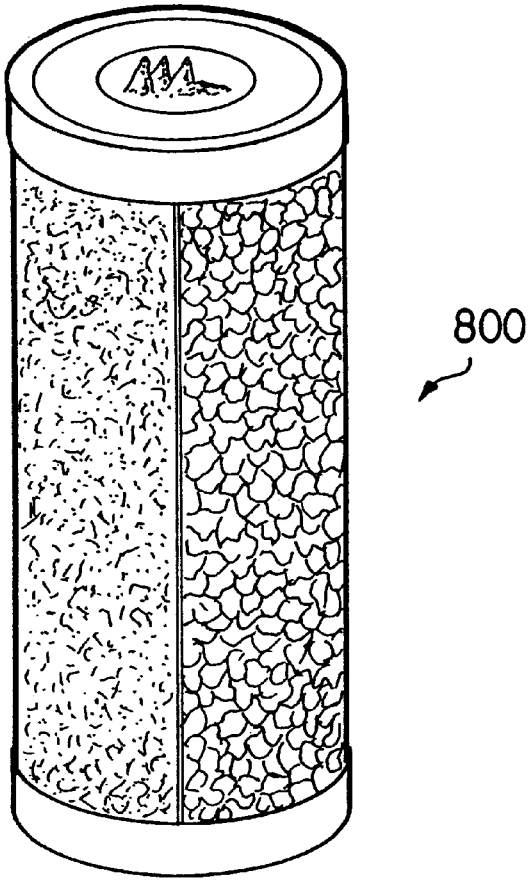
FIGS. 11A–11C illustrate an eighth embodiment of a decorative carrying case to be used with the mineral bath kit according to the invention.
Figure 11B:
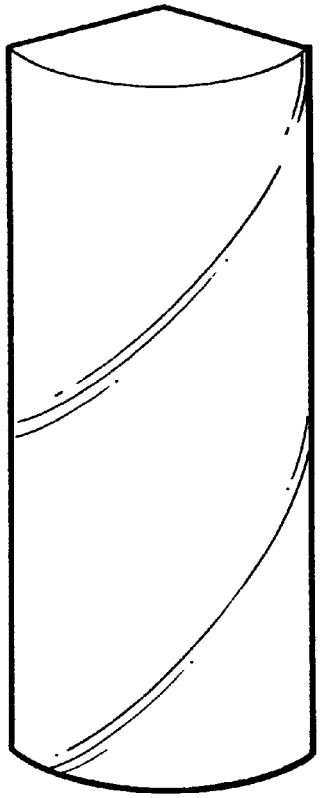
Figure 11C:
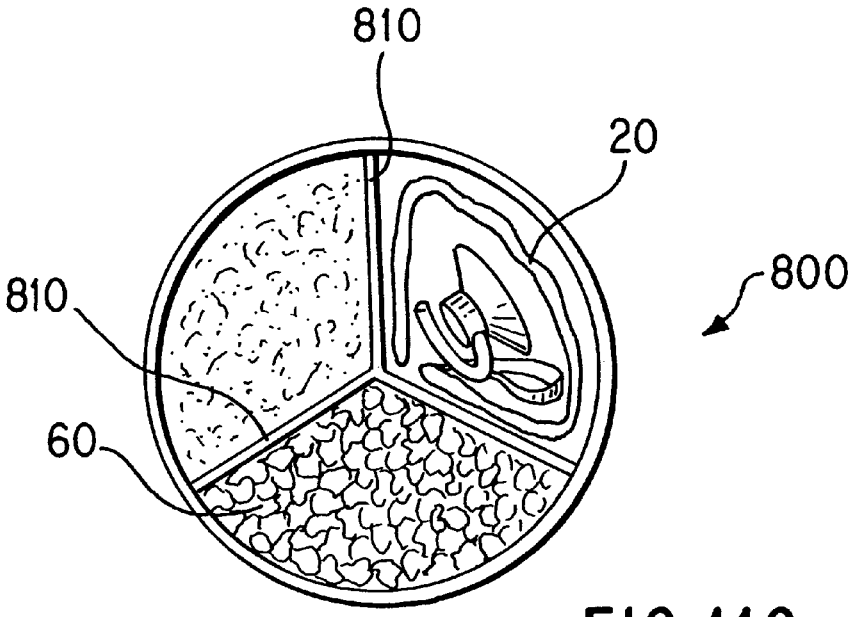

FIGS. 11A–11C illustrate a decorative carrying case 800 in the shape of a cylindrical canister. The cylindrical canister can be provided with internal, longitudinally-extending partitions 810 that separate the canister into compartments for containing the minerals 60, other products such as bath salts, if desired, and a water-permeable bag 20.

Figure 12:
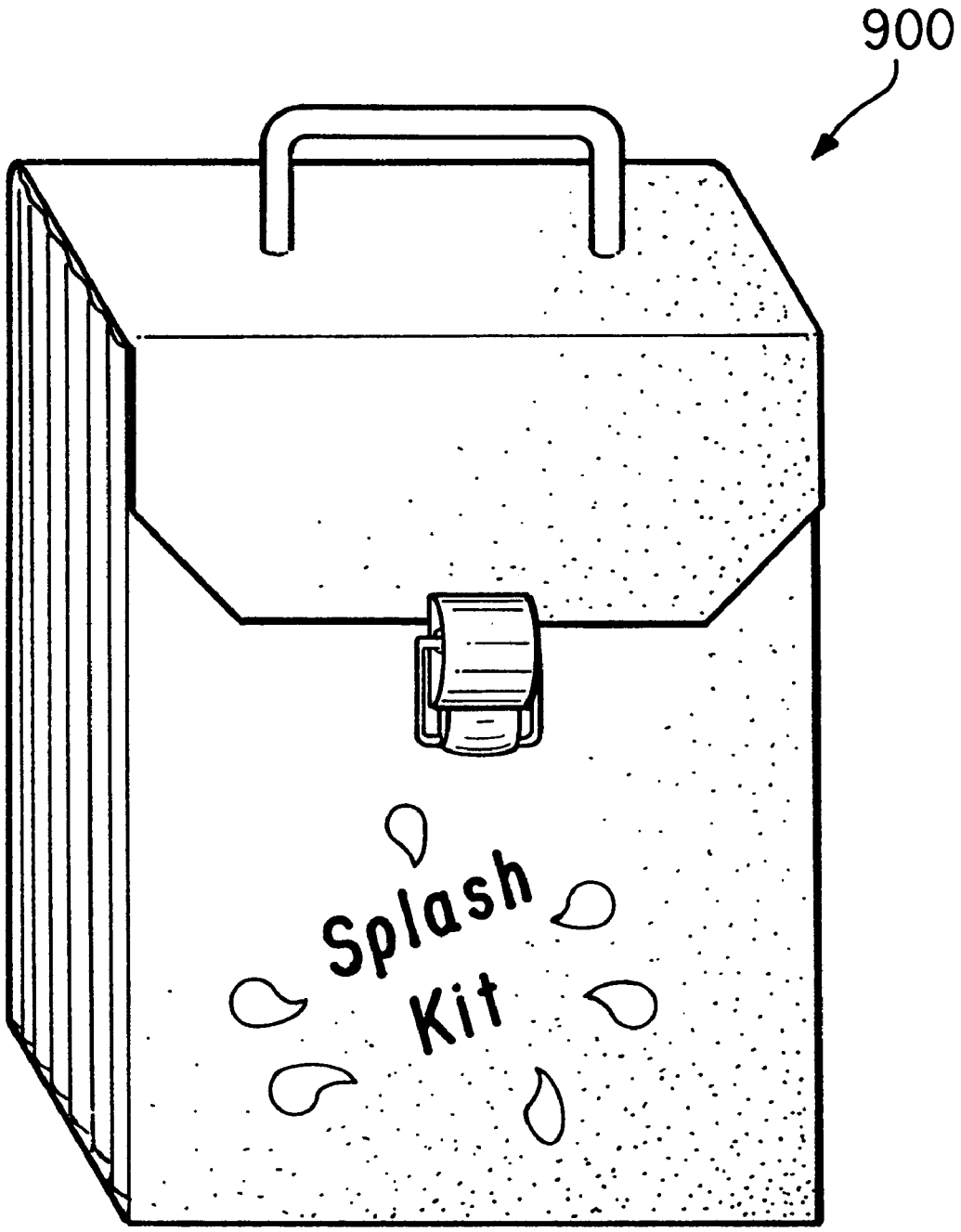
FIG. 12 illustrates a ninth embodiment of a decorative carrying case.

FIG. 12 illustrates another decorative carrying case 900 for transporting the mineral bath kit of the invention.

Figure 13A:
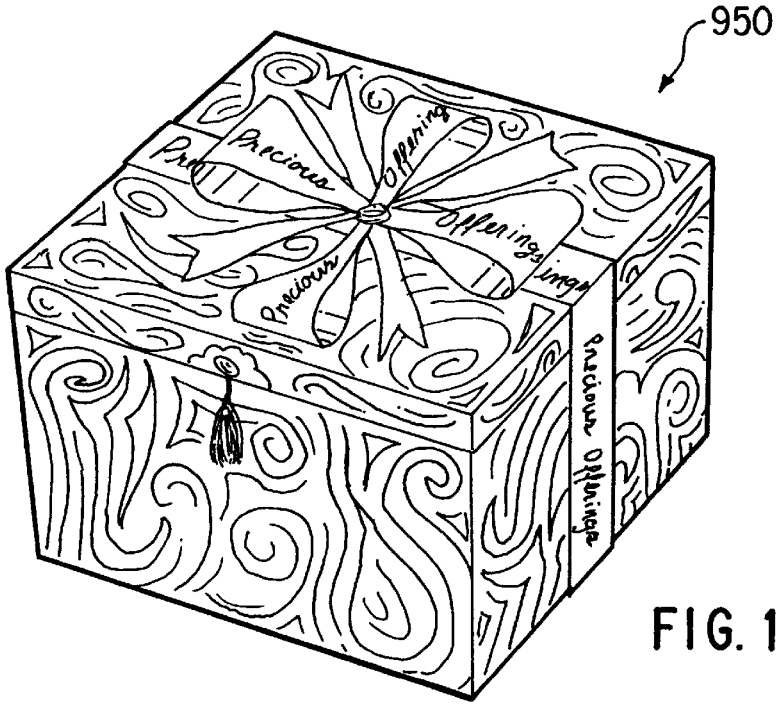
FIG. 13A illustrates a tenth embodiment of a decorative carrying case in a closed position.
Figure 13B:
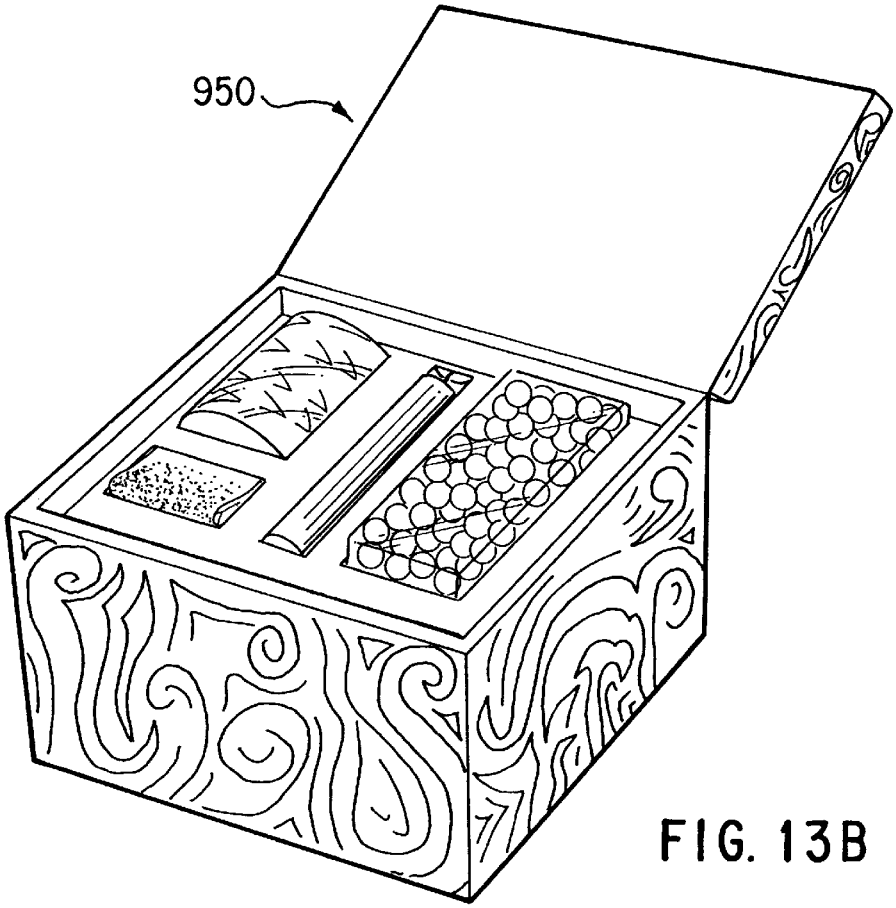
FIG. 13B illustrates the carrying case of FIG. 13A in an open position.

Yet another embodiment of the decorative carrying case for the mineral bath kit is shown in FIGS. 13A and 13B. The decorative case 950 shown in FIGS. 13A and 13B can be in the form of a padded brocade box containing sealed glass jars of the minerals and a water-permeable bag and hanger in accordance with an embodiment of the invention.

It will be apparent to those skilled in the art that various modifications and variations can be made without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A mineral bath kit, comprising:

minerals, said minerals being in the form of chips or small rocks;

a reusable water-permeable bag for containing said minerals, said water-permeable bag having an openable and resealable end through which said minerals can be inserted or removed from said bag;

said minerals containing water-soluble, therapeutic elements that are leached from said minerals into water when said minerals are contained within said bag and immersed in water, leaving behind attractive crystals contained within said bag after multiple immersions of said bag in water; and means for hanging said bag above a water receptacle.

2. The kit according to claim 1, wherein said means for hanging said bag includes a loop connected to said bag and a suction cup with a hook connected to the suction cup for engagement with the loop.

3. The kit according to claim 2, wherein said water-permeable bag is formed from a synthetic mesh material.

4. The kit according to claim 3, wherein said minerals are selected from the group consisting of quartz, lepidolite, and mica.

5. The kit according to claim 1, in combination with a decorative carrying case.

6. The combination of a kit and a decorative carrying case according to claim 5, wherein said carrying case is a box divided into compartments.

7. The combination of a kit and a decorative carrying case according to claim 5, wherein said carrying case is in the shape of an obelisk.

8. The combination of a kit and a decorative carrying case according to claim 5, wherein said carrying case is a bottle and said water-permeable bag is attached to the outside of said bottle by a shrink-wrap material.

9. The combination of a kit and a decorative carrying case according to claim 5, wherein said carrying case is a chest.

10. The combination of a kit and a decorative carrying case according to claim 5, wherein the decorative carrying case is a basket with a lid.

11. The combination of a kit and a decorative carrying case according to claim 5, wherein the decorative carrying case is a bag.

12. The combination of a kit and a decorative carrying case according to claim 5, wherein the carrying case is a wooden crate.

13. The combination of a kit and a decorative carrying case according to claim 5, wherein the carrying case is a cylindrical canister with internal, longitudinal partitions.

14. The kit according to claim 1, wherein said water-permeable bag is formed from a pile fabric.

15. The kit according to claim 14, wherein said water-permeable bag is formed from terry cloth.

* * * * *